US005146627A

United States Patent [19]

Weiser

[11] Patent Number: 5,146,627

[45] Date of Patent: Sep. 15, 1992

[54] GOLF GLOVE WITH REDUCED PALMAR AREA AND METHOD OF MAKING

[76] Inventor: Charles W. Weiser, 1310 Providence Rd., NE., Massillon, Ohio 44646

[21] Appl. No.: 724,711

[22] Filed: Jul. 2, 1991

[51] Int. Cl.[5] ..... A41D 19/00

[52] U.S. Cl. ..... 2/161 A; 2/169

[58] Field of Search ..... 2/161 A, 165, 166, 159, 2/169, 160, 161 R, 159, 161 A, 161 R, 169, 16; 273/183 B, 166

[56] References Cited

U.S. PATENT DOCUMENTS

| | | | |
|---|---|---|---|
| 689,558 | 12/1901 | Meyers | 2/159 |
| 1,716,221 | 6/1929 | Fernie | 2/161 A X |
| 1,922,095 | 8/1933 | Jones | 2/159 |
| 2,456,678 | 12/1948 | Cole | 2/159 |
| 2,554,991 | 5/1951 | Kramer | 2/159 |
| 2,858,542 | 11/1958 | Ogg | 2/161 |
| 2,975,429 | 3/1961 | Newman | 2/159 |
| 3,387,306 | 6/1968 | Korey | 2/159 |
| 3,394,408 | 7/1968 | Bush | 2/159 |
| 3,504,379 | 4/1970 | Glick | 2/161 A |
| 3,532,234 | 10/1970 | Masstab | 273/166 |
| 3,548,414 | 12/1970 | Fujita | 2/169 |
| 3,588,917 | 6/1971 | Antonious | 2/161 |
| 3,952,333 | 4/1976 | Fujita | 2/161 A |
| 4,051,552 | 10/1977 | Widdemer | 2/161 A |
| 4,453,275 | 6/1984 | Kawada | 2/161 A |
| 4,590,625 | 5/1986 | Keim | 2/161 |

*Primary Examiner*—Werner H. Schroeder
*Assistant Examiner*—Sara M. Current
*Attorney, Agent, or Firm*—Michael Sand Co.

[57] ABSTRACT

This invention relates to an improved golf glove and method of making same whereby the palmar area is reduced in dimensions in an oval-shaped configuration to eliminate wrinkling or bunching thereat. A close smoother fit of the hand at the palm area is obtained in the crease or fold line areas of the wearer's palm where an overlapped seam is created as manufactured or in modified gloves for improved gripping. The finger and thumb stalls are slightly lengthened by a minimum of about ⅛ inch in the case of the full-glove, and the wrist area is slightly lengthened by a minimum of about ½ the maximum width of the oval in both full and half-gloves to ensure a taut fit thereat which is most comfortable and efficient for club gripping.

3 Claims, 1 Drawing Sheet

GOLF GLOVE WITH REDUCED PALMAR AREA AND METHOD OF MAKING

TECHNICAL FIELD

The present invention relates generally to gloves and, more particularly, to an improved golf glove for use by a golfer to obtain a more positive and accurate grip about the hand grip area of a golf club during the game of golf, the glove ensuring greater holding power of the hand on the golf club handle, than when the golf club is gripped by the bare hand or by a single-layer conventionally-contoured glove worn on the hand. The invention relates to a wide variety of golf glove types including those made of varying materials of both the full-hand and half-glove types.

BACKGROUND OF THE INVENTION

Following detailed investigation of the game of golf and many types of presently-available golf gloves, it has been found that one of the major reasons conventional golf gloves do not and cannot provide an improved grip of the golfer's hand upon the club handle is that such gloves closely follow the contour of the normal hand facing surfaces when the hand is fully extended. Both friction-type and non-friction-type gripping strips have been utilized on prior art gloves on their exterior facing surfaces to prevent slippage of the club in the golfer's hand; however, such strips do not improve the actual grip of the golfer's hand about the club. Exterior pads have also been provided on the glove gripping surfaces, both by themselves and in combination with non-slip strips. Such pads and strips have primarily been provided to cushion the golfer's hand to prevent blisters and callouses as well as undue muscle fatigue. Such additions have been somewhat successful for their intended purposes while not significantly improving the gripping technique of the golfer's hand about the club handle area.

Conventional golf gloves are unable to improve the gripping technique of the golfer's hand on the club since upon gripping the golf club in the hand, it is readily apparent that certain voids and other open areas are present between the surface of the hand and the surface of the golf club hand grip when a conventional single-layer glove is used. This is true whether the club grip is round, oval or other contoured shape such as a reminder grip to help maintain the club gripping surface in proper alignment with the clubhead face. The golf glove serves as an adhesive force between the club grip and the golfer's hand. The voids and open areas severely limit the firm contact area between golfer's hand and the golf club grip such that a substantial amount of control of the club during swinging movement is lost especially at the extremities of the swing. Such voids and open areas are created as a result of the contrasting soft fleshy portions of the fingers and especially the palm of the individual's hand when the golfer's hand grips the contoured surface of the golf club grip. The palmar area of the glove normally wrinkles at the crease areas of the palm of the hand when gripping the club, thereby decreasing the hand holding power. It is essential that the golfer be able to recreate and repetitiously perform the proper gripping action of the club at address of the ball and during the swing for best results and continuing improvement.

In golf language and especially in the language of teaching golf, it is nearly impossible to define the term "feel" when a right-handed golfer grips the golf club shaft with both hands, the right hand being termed the power hand, and the left hand, which is normally situated above the right hand on the golf club grip, being termed the accuracy hand. Innumerable definitions have been set forth to describe the "feel" of the golf club grip in the golfer's hands, and many explanations have been set forth as to what the term "feel" actually means. It has been concluded by many professional golfers that the relationship between the hands and the brain is all important wherein the brain takes into account many environmental as well as mental and physical factors at the particular time when the golf club grip is grasped in proper relationship as taught by many golf teaching experts. Additionally, "feel" is commonly defined in the golfer's sense of the golf club grip in the golfer's hands and how the brain perceives the golf club to be grasped in the hands when properly held at address immediately prior to swinging movement. The sensory perception of the pressure information from the hands to the brain allows the brain to make the proper decisions at address of the ball which then inform the golfer's muscles how to move and/or adjust the hands upon the golf club. Thus, the brain determines that a correct "feel" is obtained as the golfer prepares for hitting the ball.

As is common knowledge, virtually all right-hand golfers prefer to wear a golf glove on their left hand, both to protect the hand and provide increased accuracy of the gripping action and to improve the swinging movement of the club for consistent and repeatable hitting. The palm of the hand in its natural position is slightly concave providing a concavity which deepens as the hand flexes in grasping the golf club grip. When the smaller fingers at one side of the concavity of the palmar area, on the opposite side of the concavity from the thumb, feel the greatest pressure on the straight club shaft lying across the palm, the diagonal relationship of the club to palm allows the minor fingers of the hand starting with the little and ring fingers to apply initial pressure on the golf club handle. When the club is properly held, the minor fingers of the hand starting with the little, ring and middle fingers, in that order, close around and surround the club handle. If the accuracy hand is deformed from the preferred grip when grasping the club as well as when making the swing, control of the swing may be substantially altered due to club slippage and positive firm gripping may not be maintainable throughout the swing. Problems of maintaining the proper grip throughout the swing especially at its extremities may be considered as a primary cause of golf being referred to as an especially difficult game.

It is a noticeable trend of many golfers to wear very tight gloves in an attempt to enhance "feel" by being able to feel the glove on the hand and the club handle through the glove. The actual gripping force is deleteriously affected as the closed hand within the glove produces voids or open areas in the fold or crease areas of the palm which are contrary to obtaining improved gripping with more uniform compressive force of the hand on the club grip. This is most critical during the address and swing. During the swing, the clubhead creates centrifugal force which tends to pull the club out of the hand. Also torsional forces are created which tend to turn the clubface out of precise alignment with the target. The latter forces are rotational in nature which are most pronounced when the grip weakens or the guiding accuracy hand separates in the least amount from the club grip area, especially at or near the top of the backswing. A weak grip is the most common reason for a bad or undesirable shot as taught by most professionals. The present invention of an improved golf glove solves the problem of proper gripping and its continued maintenance throughout the swing.

SUMMARY OF THE INVENTION

The present invention relates to an improved golf glove and, more particularly, to a reduced surface area of the palm of a golfer's glove to enhance "feel" and gripping power of the hand on the golf club, and to prevent slippage between the two, and thereby improve the golfer's swing. The reduced surface area of the palm has a contour complemental to the major flexed portion of the palm when closed about the club grip, whereby the golfer in grasping the golf club handle, has an enhanced "feel" of the golf club and more uniform compressive pressure over a greater area between the hand and club to better control the swing of the golf club for improved hitting. The reduced palm surface is useful with a wide variety of golf glove types and styles including those made of soft pliable leather or other synthetic materials of both the full-hand and half-glove types.

The reduced area is preferably formed in the golfer's left hand glove which is normally used by a right-handed golfer. Preferably the smaller palmar area of the glove is most important when the palm is closed in creating and maintaining proper compressive force on the club without wrinkling thereat, especially at address and through the extremities of the swing. The reduced area has a contour complemental to the concavity of the golfer's left-hand closed palm (for a right-handed golfer) adapted to closely match the natural concavity of the palm when the club is properly gripped. The reduced palm is adapted to surround the straight line of the golf club handle and provide greater gripping force by the palmar area of the hand. Substantially equal pressure can be made to be felt across the wearer's palm area as the fingers and palm surround and enclose the golf club handle, backfilling the voids and open areas between the palmar areas of the glove and hand and providing a broader gripping area when encircling the golf club grip. Obviously, the reduced area having a mirror-image contour may be used within a golfer's right hand glove which is used by a left-handed golfer on the accuracy hand.

The smaller fingers of the hand exert the greatest holding power when the club is gripped and held against the palm in proper relationship as taught by most golf professionals. The minor finger areas which provide the greatest gripping pressure along with the thumb against the palm are the first to inherently open up or tend to release their gripping pressure and cause slippage from the club particularly on the backswing when the left arm is fully extended. Keeping the left arm straight on the backswing prior to moving the club downwardly and forwardly into the ball impact area tends to cause such slippage or loss of proper grip to occur. Such relaxation of finger pressure and slippage in the palm area frequently results in inadequate solid gripping at impact causing errant shot making. The reduced palm aids in maintaining the firm grip throughout the swing by broadening the retention area and providing more uniform compression. With greater holding power over a greater area, slippage between hand and club is much less likely to occur. The palmar area of the glove also may have a series of spaced-apart perforations to preclude the formation of air pockets between hand and club, and to provide a cooling effect.

Accordingly, it is an object of present invention to provide a reduced surface area within a golf glove to enhance the pressure being felt between the juxtaposed palm on the straight golf club shaft providing greater and more uniform compressive force on the club over a broader area with less tendency of the palm area to separate from the club shaft or to result in relative slippage between hand and club at both the initiation and swinging movement of the club.

It is another object of the present invention to provide a reduced surface area at the palm of the golf glove, and more specifically at the fold or crease lines of the golfer's hand. The palmar reduced area is formed in full-hand or half-glove types of a pliable golf glove. The reduced palm provides a most important retention area to prevent undesirable rotation or loss of firm retentive contact of the club between hand and shaft during hitting movement. The golfer, in grasping the club handle, has an enhanced feel of the golf club at the palm and more uniform compressive pressure between the hand and club to better control the swing of the golf club for improved hitting. Also the reduced palm having the prescribed lesser dimensions prevents undue shock being imparted to the hand, wrist and/or arm on ball impact, and particularly when a large divot is taken, or when the ball is struck on extremely hard or rocky ground.

A still further object of this invention is to provide a reduced surface area for the palm especially at the crease lines, which permits the palm to work together with the fingers of thin pliable golf glove to ensure a more firm grip resulting in less torque or slippage between the hand and the club handle. The reduced palm type of glove may be available in different sizes to be manufactured, or conventional gloves may be modified to incorporate this feature.

A still further object of the present invention is to increase the feel of the palmar area of the hand on the golf club handle for improved retention of the club in proper hitting relation and to increase the compressive force applied by the selective palmar areas of the hand for better control and increased accuracy of the golf club stroke.

Other objects and advantages of the present invention will, in large part, be obvious and will in part appear hereinafter in the specification.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts and elements throughout the drawings.

DESCRIPTION OF THE PREFERRED EMBODIMENT

Figure 1:
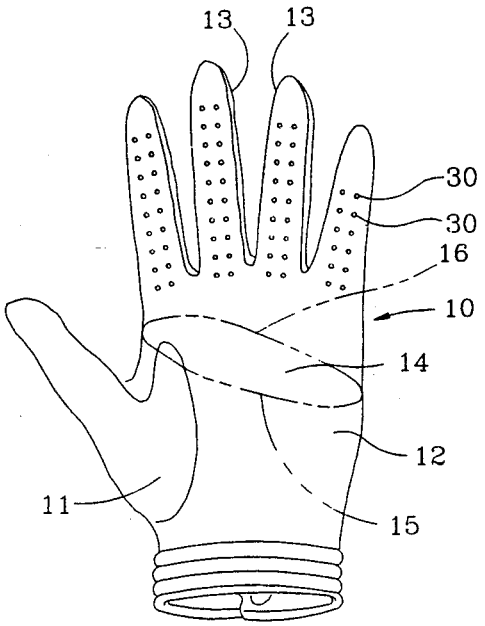
FIG. 1 is a front view of a conventional full-hand golf glove ready to be modified in accordance with this invention.

A preferred embodiment of the present invention is shown in FIG. 1 which is a front view of the left-hand glove 10 of the full-glove type for a right-handed golfer. The glove normally is formed of leather, synthetic leather-like material, or synthetic material combined with leather, to tightly encompass and follow essentially the full contour of the left hand. The glove 10 preferably is formed as a full-hand glove encompassing the complete hand rather than a half-glove which has the finger areas cut off at their mid-point. The invention will be firstly described with respect to the full-hand glove type and secondly with respect to the half-glove type as set forth hereinbelow.

The glove 10 is normally made as a single-layer of material with a thumb-piece portion 11 sewn to the palm portion 12 to permit free movement of the thumb and provide a tight fit. In conventional gloves, the finger elements 13 are normally sewn to the palm portion 12, the facing and rear portions of the finger elements normally having small apertures therein for proper ventilation.

FIG. 1 illustrates in broken-line outline the palmar surface area of the glove which is reduced in dimensions at a central region. Such area has a generally long flat oval-shaped configuration which resides over the crease or fold lines of the skin of the wearer's palm. Such area is generally ellipsoidal in shape when laid in a common plane having long pointed ends extending beyond the width of the palm. The area has a width at its mid-point ranging from about ¼ to 1¼ inch depending upon hand size. It is this area which experiences the greatest amount of wrinkling when the gloved hand is closed around the club grip.

Figure 2:
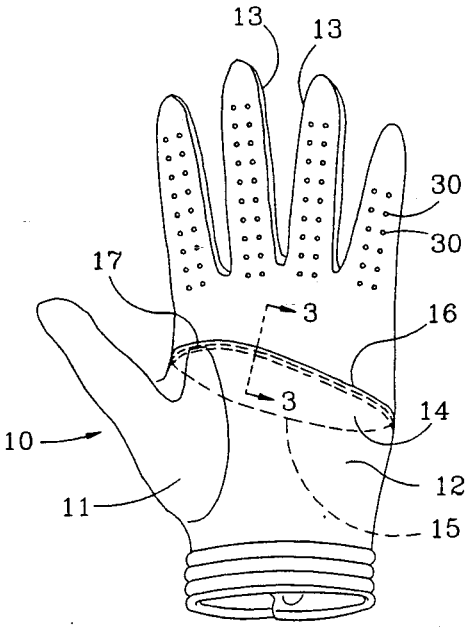
FIG. 2 is a similar front view of the same glove being modified in accordance with this invention.
Figure 3:
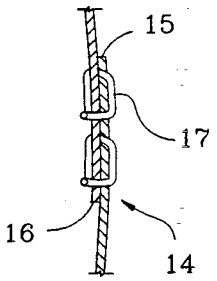
FIG. 3 is a fragmentary vertical sectional view of the modification taken along the line 3—3 of FIG. 2.

FIG. 2 shows how the reduced area 14 is actually reduced in dimensions when a conventional glove is modified in accordance with this invention. The lower curved line 15 of the oval-shaped configuration is severed and overlapped upwardly interiorly of the glove to the upper curved line 16. The overlapped area is then sewn at the upper line 16 such as by nylon thread 17 as shown in FIGS. 2 and 3. An adhesive material may also be employed in permanently joining the overlapped area. Thus, the glove is then formed with a shortened palm which closely matches the full concavity of the palm when the hand is closed around the club grip. A taut fit is thereby obtained which virtually eliminates wrinkling at the creases of the palm when gripping the club. Voids or open areas thereat between the hand and club are avoided which lessened the palm gripping power. More uniform gripping pressure over a greater surface area is then obtained. Thus, the gripping action is increased both qualitatively and quantitatively, being less dependent upon the hand strength of the golfer.

The modification of the palm area of the subject glove may be made in the original glove as manufactured as well as made to conventional gloves utilizing the aforesaid description for area reduction. The long flat oval-shaped configuration pattern is correctly determined through cupping the gloved hand and marking the area which occurs directly over the voids and wrinkles in the palm area to determine the amount of excess material to be removed from the palmar area. In describing the design of the material to be removed, it should be stated as the configuration of a long flat oval-shape with a design difference in the required curvature of the top and bottom lines 15 and 16 of the oval. As an additional facet of the removal of glove material in the palmar area, it should be noted that it creates a curvature of the fingers as an involuntary movement which aids in the gripping of the club. In the original manufacture of the glove, the thumb piece 11 joined to the palmar area should be cut more flat in the palmar area rather than the standard V-shape. Also, the finger stalls 13 and thumb piece 11 should be extended by a minimum of about ⅛ inch to ensure a more comfortable fit in those areas in view of the shortened palm. In addition, the wrist area material should also be extended a short dimension, preferably to a minimum of about ½ the maximum width of the "oval" in the palmar area. The force or forces which exist or are exerted in the palmar and finger areas, resulting from the reduction of the material in the palmar area, are readily observable in assisting the closing of the hand around the club. The facing surfaces of the finger stalls have a spaced-apart series of small openings or perforations 30 (as shown) for ventilation and cooling, and the palm area 12 may optionally also have such openings for the same purpose.

The initial method for obtaining the precise shape of the design "oval" in the palmar area consists of a closing of the hand and fingers into a more cupping position from the straight-out or fully-extended finger/hand position. The cupping of the hand and fingers will result in a more natural hand-carrying position and will determine the amount of excess material in the palmar area to be removed. The "oval shape design" which results after marking the glove for material removal, denotes the excess material that exists over the void in the hand area. The seam in the golf glove runs through the palmar area over the void in the hand (i.e. over the fold or crease lines) which connects the two sides of the cut in the palmar area. The seam at such position does not interfere with proper club gripping action and actually strengthens the glove at such area due to the overlap.

The half-glove is manufactured to all of the aforesaid specifications with the exception of the extension of the finger and thumb stalls by a minimum of ⅛ inch.

Figure 4:
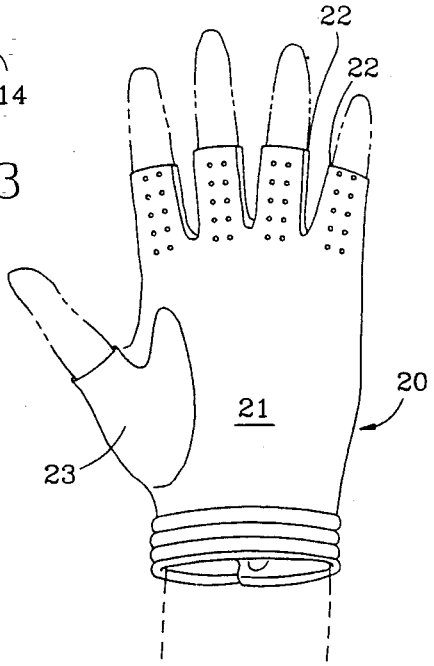
FIG. 4 is a front view of a conventional half-glove type of golf glove ready to be modified in accordance with this invention.

As shown in FIG. 4 of the drawings, the reduction in the palmar area may also be effected in the structure of the half-glove 20 since such glove may be similarly shortened or reduced in area in the palm 21 as described for the full-glove type reduction of the palmar area. The half-glove may be fully modified as aforesaid to assist in cupping the hand and avoiding wrinkling in the crease of fold lines of the palm. In such half-gloves, the finger stalls 22 are shortened or cut-off normally at the mid-point or middle knuckle of the fingers as well as at the thumb 23 to also provide the increased gripping force in the palm.

Figure 5:
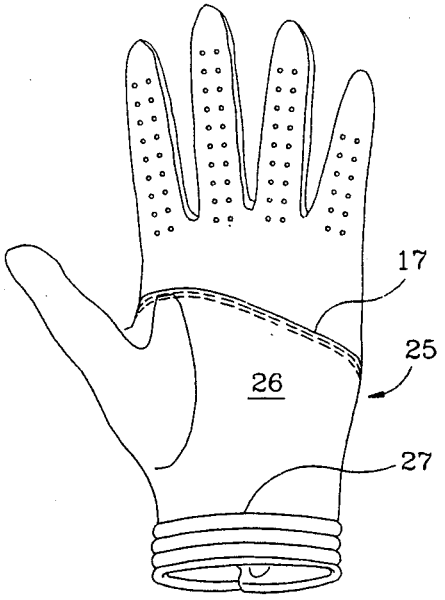
FIG. 5 is a front view similar to FIG. 1 of a full-hand golf glove made with a reduced palmar surface having a slightly lengthened wrist area.

As shown in FIG. 5 the glove 25 has the palm 26 reduced in axial dimensions; however, the wrist area 27 of the glove has been lengthened to ensure that the glove provides a proper fit in the wrist area. As stated, the wrist area is lengthened by about ½ the reduction of the maximum width of the oval pattern.

Reduction of the glove material in the palmar area is based on the current state of the art gloves for determining the length of material from the wrist to the stalls of the fingers. The palmar reduction is made from now-existing lengths determined for this area in all glove sizes currently manufactured. As described, the improved glove has been manufactured from conventional golf gloves now available in the marketplace. However, when the glove material is being die cut or stamped out by the manufacturer, such original manufacture permits cutting the material in the palmar area to lesser dimensions eliminating material exactly in the void area of the hand. Therefore, the full-hand glove will be modified in three primary areas according to the invention i.e. (1) the palmar area with the two lines (one to be cut) of the long flat oval shape with two different curvatures, exactly in the central palm area over the fold lines of the palm, with a seam formed thereat, (2) the material at the wrist area completely around the glove opening being extended in material length cut longer by a minimum of about ½ the oval maximum width dimension to compensate for the width of material which is reduced in the palm area in the wrist-to-finger direction; and (3) the slightly lengthened fingers to compensate for the reduced palm for a more comfortable taut fit.

The improved structure of the subject glove addresses the problem of bunching and gathering of the glove material in the palmar area. Such problem occurs when the hand closes around the club grip which increases the amount of material in the fold lines of the palm. The improved structure is applicable to all golf glove sizes; small, medium, large, extra-large, etc.

The excessive material is gathered and marked in the resulting pattern in the hand void area as shown in FIGS. 1 and 2. When the flat oval is cut along one edge, overlapped and sewn together as shown in FIGS. 2 and 3, the excess material in the palmar area is reduced. Because of the reduction of material length in the palm, the wrist area of the glove must be lengthened axially. Also, the finger and thumb stalls must be lengthened slightly axially for an improved fit.

Increased gripping action and stability are attainable without exerting substantially increased effort or compressive pressure in the area of the hand. Increased gripping ability increases the hand-to-club relationship and permits more ready reproducibility of the preferred grip and increased "feel" which thereby aids in reducing the torque and slippage between the gloved hand and the club during swinging movement of the club. Thus, repeatability of the swing is attainable which cannot be obtained by prior art alone.

The reduction in the palmar area of the subject glove may also be used in other types of athletic gloves to grasp the handle of other sports devices such as a tennis racket, baseball bat or softball bat in an improved manner. The lesser palm area provides more firm gripping with increased stability and lesser slippage between the hand and handle prior to and during impact with the ball.

Accordingly, the improved golf glove and method of making are simplified, providing an effective, safe, inexpensive, and efficient athletic glove and method of grasping which achieves all of the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

Having now described the features, discoveries and principles of the invention, the manner in which the improved golf glove and method of making is practiced in its several forms, the characteristics of construction, and the advantageous, new and useful results obtained; the new and useful structures, devices, elements, arrangements, parts and combinations, are set forth in the appended claims.

I claim:

1. The method of improving a conventional golf glove to enhance feel and gripping power of a golfer's hand on a golf club comprising the steps of severing an area of a palmar facing surface of said glove in a curvilinear pattern substantially parallel to a wearer's palmar fold lines, overlapping the said severed area of said palmar facing surface of said glove in a long flat oval-shaped configuration, and forming a seam with an adjacent portion of said palmar facing surface to reduce the palmar facing surface area adjacent the said palmar to fold lines so that on closing flexure of the wearer's hand a taut non-wrinkling fit is obtained.

2. The method of improving a conventional golf glove in accordance with claim 1, including the step of overlapping the severed area of the palmar facing surface in a long flat substantially oval-shaped configuration extending transversely beyond a wearer's palmar area adjacent and parallel to a wearer's major palm fold line, and forming a sewn seam at the overlapped edge.

3. The method of improving an athletic glove to enhance feel and gripping power of a wearer's hand on a handle of an athletic device comprising the steps of severing an area of a palmar facing surface of said glove in a curvilinear pattern substantially parallel to a wearer's palmar fold lines, overlapping the said severed area of said palmar facing surface of said glove in a long flat oval-shaped configuration, and forming a seam with an adjacent portion of said palmar facing surface to reduce the palmar facing surface area adjacent the said palmar fold lines so that on closing flexure of the wearer's hand a taut non-wrinkling fit is obtained.

* * * * *